United States Patent [19]

Sakurai

[11] Patent Number: 5,031,590

[45] Date of Patent: Jul. 16, 1991

[54] FUEL SUPPLYING SYSTEM FOR INTERNAL COMBUSTION ENGINE

[75] Inventor: Yoshihiro Sakurai, Hamamatsu, Japan

[73] Assignee: Sanshin Kogyo Kabushiki Kaisha, Hamamatsu, Japan

[21] Appl. No.: 42,562

[22] Filed: Apr. 23, 1987

Related U.S. Application Data

[63] Continuation of Ser. No. 673,908, Nov. 21, 1984, abandoned.

[30] Foreign Application Priority Data

Nov. 29, 1983 [JP] Japan ..... 58-223351

[51] Int. Cl.[5] ..... F02M 1/16

[52] U.S. Cl. ..... 123/187.5 R; 123/73 R

[58] Field of Search ..... 123/187.5 R, 187.5 P, 123/73 A, 73 R, 73 B

[56] References Cited

U.S. PATENT DOCUMENTS

| | | | |
|---|---|---|---|
| 4,264,536 | 4/1981 | Yoschioka | 123/187.5 R |
| 4,457,271 | 7/1984 | Fitch | 123/187.5 R |
| 4,462,346 | 7/1984 | Haman | 123/187.5 R |
| 4,542,723 | 9/1985 | Fujimoto | 123/187.5 R |

FOREIGN PATENT DOCUMENTS

| | | | |
|---|---|---|---|
| 4812410 | 2/1973 | Japan | 123/187.5 R |
| 51-158921 | 12/1976 | Japan | 123/187.5 R |
| 52-124531 | 10/1977 | Japan | 123/187.5 R |
| 52-45844 | 11/1977 | Japan | 123/187.5 R |
| 56-66435 | 6/1981 | Japan | 123/187.5 R |

*Primary Examiner*—Carl Stuart Miller

*Attorney, Agent, or Firm*—Ernest A. Beutler

[57] ABSTRACT

Several embodiments of charge forming systems for crankcase internal combustion engines each of which embodies a first charge forming device having a main fuel discharge that delivers a fuel/air mixture to the crankcase and a second charge forming device having an idle fuel discharge for delivering a fuel/air mixture to the transfer passage. The second charge forming device is provided with means for providing cold running enrichment. In addition, a priming fuel pump is adapted to supply priming fuel of a higher quality to the first charge forming device upstream of its venturi section. The two charge forming devices are each supplied with air from a common air inlet device that includes at least a air silencer. The communication of the second charge forming device with the air supply device is such so as to preclude the likelihood of fuel leakage if the engine is oriented in other than its normal condition.

9 Claims, 3 Drawing Sheets

FUEL SUPPLYING SYSTEM FOR INTERNAL COMBUSTION ENGINE

This is a continuation of U.S. patent application Ser. No. 673,908, filed Nov. 21, 1984, now abandoned.

BACKGROUND OF THE INVENTION

This invention relates to a fuel supplying system for internal combustion engines and more particularly to an improved charge forming device for engines and particularly those of the two-cycle type.

As is well known, it is the practice to provide additional fuel to an internal combustion engine to assist in cold starting. Additional fuel is required under these conditions since the engine and its major components are cold and the low temperature causes fuel condensation which, unless compensated for, can result in a too lean mixture for good starting or cold running. This problem is particularly acute in connection with two-cycle, crankcase compression engines where the fuel-/air charge is introduced into the crankcase and is subsequently transferred to the combustion chamber through one or more transfer passages during the piston reciprocation. Because of the long route of travel from the crankcase to the combustion chamber for the fuel air mixture, the condensation problems at low temperatures become particularly acute.

It has also been proposed to run two-cycle, crankcase compression engines on fuels having lower quality that gasoline. Alcohol and kerosene are typical of such low quality fuels on which two-cycle engines have been operated. However, when using these lower quality fuels, it has been the practice to provide a richer fuel such as gasoline for priming and cold starting. However, the priming systems previously employed had the fuel discharge into the engine induction system at a point where the discharge is exposed to a high engine vacuum condition. Thus, this high vacuum can cause excess of the higher quality fuel to be drawn into the engine at times when it is unnecessary and thus offset the disadvantages of running on low quality fuel.

It is, therefore, a principal object of this invention to provide an improved priming system for an internal combustion engine.

It is a further object of this invention to provide an engine priming system wherein the priming fuel will not be depleted during normal engine running.

It is a yet further object of this invention to provide a priming system for an internal combustion engine wherein the discharge of the priming fuel is so located that the priming fuel will not be depleted during normal running.

As has been noted, the problems of fuel condensation in crankcase compress, two-cycle engines at low temperatures are well known. In order to offset these deficiencies and to provide better running under all conditions, it has been proposed to provide a charge forming device which delivers a fuel/air mixture directly into the crankcase and a further charge forming device that delivers a fuel/air mixture into the transfer passage. By providing additional fuel/air discharge into the transfer passage, the likelihood of fuel condensation and the necessity for further enrichment under low temperatures can be minimized. Recently, it has also been proposed to provide cold running enrichment in the charge forming device which supplies the transfer passage. Although the use of two such charge forming devices and the incorporation of cold running enrichment in the one that serves the transfer passage has many advantages, it tends to complicate the engine fuel system in view of the fact that two separate charge forming devices are provided for each chamber of the engine.

It is, therefore, a further object of this invention to provide a compound yet simplified charge forming system for a two-cycle internal combustion engine.

It is another object of this invention to provide a charge forming system for a two-cycle internal combustion engine wherein a plurality of charge formers share a common fuel source.

One very popular application for two-cycle internal combustion engines is in connection with outboard motors. Because of the relative simplicity of the two-cycle engine and its relatively high specific output, it has been the common practice to employ two-cycle engines as the powering device of an outboard motor. The above comments with respect to the design characteristics of the induction system and charge forming device for two-cycle engines apply very strongly to outboard motors. However, with an outboard motor, there is an additional factor to be considered. That is, the engine is frequently positioned in an orientation other than that in which it is designed to normally operate. For example, outboard motors are provide with an arrangement wherein they can be tilted about a horizontally extending axis from a normal running condition to a tilted up out of the water condition. In addition, outboard motors, particularly those of smaller displacements, are frequently detached from the associated watercraft and stored in a horizontally extending position. When this is done, there is a likelihood of leakage of the fuel from the charge former which, obviously, is an undesirable situation. This problem is particularly acute when the engine is provided with separate charge formers for both the crankcase and transfer passages. When such multiple charge formers are used, it is difficult to insure that the design of each charge former is such that fuel cannot be discharged when the engine is oriented other than in its normal running condition.

It is, therefore, a further object of this invention to provide an improved charge forming device for a two-cycle engine that will minimize the likelihood of fuel leakage when the engine is positioned in other than its normal orientation.

It is a further object of this invention to provide an improved charge forming system for a two-cycle internal combustion engine that will minimize the likelihood of fuel leakage.

As has already been noted, there are advantages in connection with two-cycle, crankcase compression internal combustion engines to providing the cold starting and cold running enrichment directly to the transfer passage of the engine. Although devices have been proposed for this purpose, such as that shown in the copending application Ser. No. 631,858, filed Jul. 18, 1984 and entitled "Fuel Supply Device Of A Two-Stroke Engine For An Outboard Motor", filed in the name of Hidekazu Takayashu, and assigned to the assignee of this application, such devices have taken the form of conventional cold starting enrichments found in conventional type of carburetors. Although such arrangements are practical, they are in some instances more complicated than are required for the functions which they serve. This is particularly true, when the main fuel/air requirements are supplied by a separate charge former to the crankcase.

It is, therefore, a further object of this invention to provide an improved and simplified cold starting enrichment device for a two-cycle crankcase compression internal combustion engine.

It is a yet further object of this invention to provide an improved simplified and yet fully adjustable cold starting enrichment device for a two-cycle internal combustion engine.

SUMMARY OF THE INVENTION

A first feature of this invention is adapted to be embodied in a charge forming device for an internal combustion engine comprising body means defining an induction passage having a venturi section, a throttle valve in the induction passage for controlling the flow therethrough, a main fuel discharge for discharging fuel into the induction passage contiguous to the venturi section and a manually actuated priming fuel pump for starting priming. In accordance with the invention, means are provided for discharging fuel from the manually actuated priming fuel pump to the induction passage upstream of the venturi section.

Another feature of the invention is adapted to be embodied in a fuel supply system for a two-cycle, crankcase compression internal combustion engine that comprises a cylinder, a piston reciprocating in the cylinder, a crankcase and transfer means for transferring a charge compressed in the crankcase to the area in the cylinder above the piston for at least a portion of the piston stroke. First charge forming means are incorporated for delivering a fuel/air charge to the crankcase and second charge forming means are incorporated for delivering a fuel/air charge directly to the transfer means independently of the crankcase. Cold running enrichment means are provided for delivering an enriched fuel/air mixture to the transfer means. In accordance with this feature of the invention, the first and second charge forming means are supplied with fuel from the same fuel bowl.

Yet a further feature of the invention is also adapted to be embodied in a fuel supply system for a two-cycle, crankcase compression internal combustion engine having a cylinder, piston, crankcase and transfer means as set forth in the preceding paragraph. First charge forming means are provided for delivering a fuel/air charge to the crankcase and second charge forming means are provided for delivering a fuel/air charge directly to the transfer means independently of the crankcase. In accordance with this feature of the invention, a common air inlet device supplies air to each of the charge forming means.

Yet a further feature of the invention is adapted to be embodied in a fuel supply system for a two-cycle, crankcase compression internal combustion engine of the type described in the preceding paragraphs. In accordance with this feature of the invention, charge forming means are provided for delivering a fuel/air charge to the crankcase. In addition, enrichment means are provided for delivering an enriched fuel/air mixture to the transfer means. This enrichment means comprises a fuel passage, an air passage, means for mixing fuel from the fuel passage and air from the air passage for forming a fuel/air mixture for induction into the transfer means and valve means for controlling the flow through one of the passages for enrichment of the fuel/air mixture delivered to the transfer means.

Yet another feature of the invention is adapted to be embodied in a charge forming device that is adapted to be affixed in flow exchange relationship with the transfer passage of a two-cycle, crankcase compression internal combustion engine. Such a charge forming device includes a mixing passage having a discharge end adapted to communicate with the transfer passage. A check valve is positioned in this discharge end for permitting flow from the mixing passage to the transfer passage while precluding flow in the reverse direction. A fuel supply passage is provided in communication with the mixing passage and an air supply passage is also provided in communication with the mixing passage. Valve means are provided for controlling the flow through one of the passages for effecting cold enrichment.

DETAILED DESCRIPTION OF THE PREFERRED EMBODIMENTS

Figure 1:
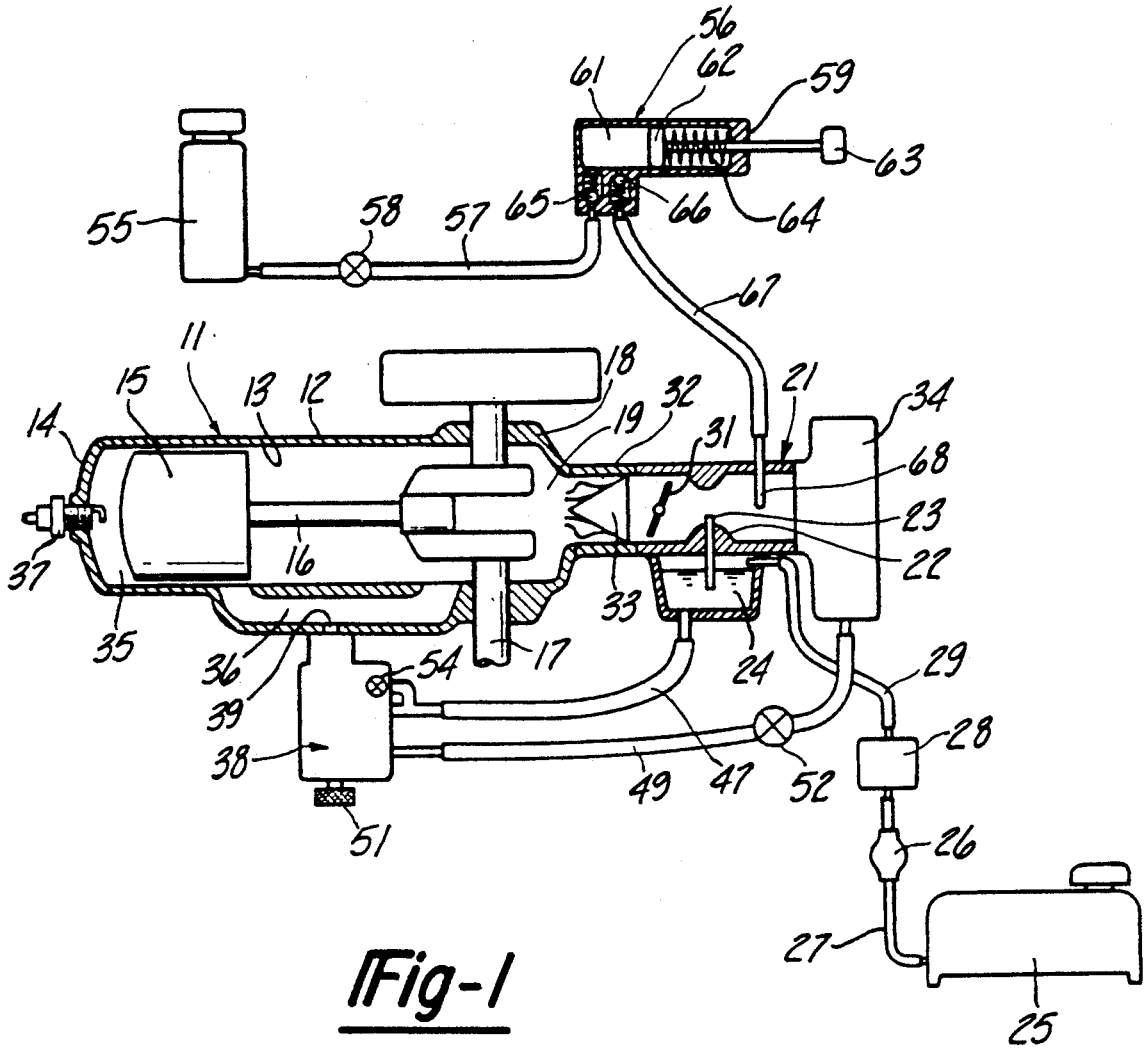
FIG. 1 is a partially schematic cross-sectional view taken through the single cylinder of an outboard motor embodying a crankcase compression, two-cycle engine and constructed in accordance with a first embodiment of the invention.
Figure 2:
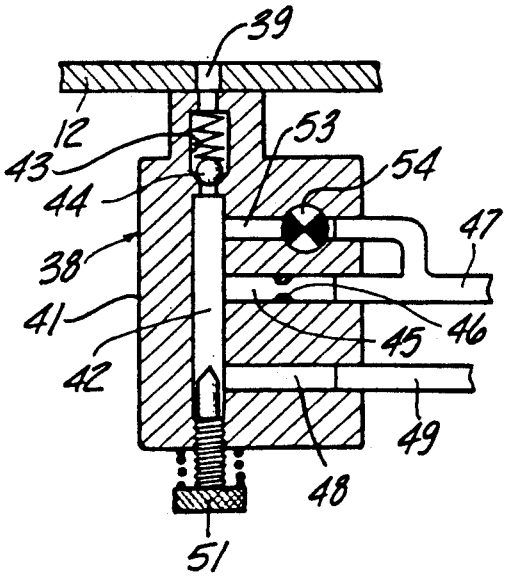
FIG. 2 is an enlarged cross-sectional view of one of the charge forming devices of this embodiment.

Referring first to the embodiment of FIGS. 1 and 2, a two-cycle, crankcase compression internal combustion engine having a charge forming device constructed in accordance with an embodiment of the invention is identified generally by the reference numeral 11. The engine 11 is particularly adapted for use as the power unit of an outboard motor and, for this reason, is disposed with a cylinder block 12 having a cylinder bore 13 that extends in a generally horizontal direction. A cylinder head 14 is affixed to the cylinder bore 13 and a piston 15 is supported for reciprocation within the cylinder bore 13. The piston 15 is connected by means of a connecting rod 16 to drive a crankshaft 17 that is supported for rotation between the cylinder block 12 and a crankcase 18 that is affixed to the cylinder block, about a generally vertically extending axis.

The crankcase 18 and area in the cylinder bore 13 below the piston 15 is sealed to provide a crankcase chamber 19. A fuel/air charge is delivered to the crankcase chamber 19 from a charge forming device in the form of a carburetor, indicated generally by the reference numeral 21. The carburetor 21 has a venturi section 22 formed in its induction passage. Fuel is discharged into the venturi section 22 from a main discharge nozzle 23 that draws fuel from a fuel bowl 24. Fuel is delivered to the fuel bowl 24 from a remotely positioned, main fuel tank 25.

A manually operated priming pump 26 is positioned in a line 27 that extends from the main fuel tank 25 to a fuel pump 28 which is powered in any suitable manner such as by engine crankcase pressure variations. The fuel pump 28, in turn, delivers fuel to the fuel bowl 24 through a conduit 29. A float operated valve, not shown, of a known type is positioned in the fuel bowl 24 so as to provide a uniform level of fuel therein.

In accordance with the invention, the engine 11 is adapted to operate primarily on a lower grade fuel than gasoline such as kerosene or alcohol. Kerosene or alcohol is, therefore, contained with the main fuel tank 25 and delivered to the fuel bowl 24 in the aforedescribed manner. If desired, the engine 11 may be lubricated either by means of a separate lubricating system, not shown, or by means of lubricant that is mixed with the kerosene or other fuel in the tank 25.

A throttle valve 31 is positioned in the induction passage of the carburetor 21 and downstream of the venturi section 22 for controlling the flow through the carburetor 21 in a suitable manner. The carburetor 21 mates with an intake manifold 32 in which a reed-type check valve 33 is provided for permitting one way flow of fuel/air mixture to the crankcase chamber 19. The carburetor 21 draws its air charge through an air inlet device 34 which may be of any known type and which may include a silencing arrangement. In addition, if the engine 11 is used for other than marine use, the air inlet device 34 may also include an air filter.

The charge from the carburetor 21 is cyclically inducted into the crankcase chamber 19 when the piston 15 is moving upwardly in its stroke. Alternatively, when the piston 15 moves downwardly, it will compress the fuel/air mixture in the crankcase chamber 19. The compressed charge is then transferred to a combustion chamber 35 formed above the piston 15 and by the cylinder bore 13 and cylinder head 14. This charge is transferred through a transfer passage 36 which has its inlet end communicating with the chamber 19 and its outlet end communicating with the cylinder bore 13 at a point that is above the head of the piston 15 when the piston 15 moves toward its bottom dead center position.

The charge which is delivered to the combustion chamber 35 is fired by means of a spark plug 37 that is supported within the cylinder head 14. The spark plug 37 is fired at the appropriate time by means of any known type of ignition system. The burnt charge from the combustion chamber 35 is discharged through the atmosphere through an exhaust port and exhaust system (not shown) which may also be of any known type.

In accordance with the invention, the carburetor 21 is provided with only a main fuel discharge system. Since the engine 11 is designed to run on a lower grade fuel, there is a problem at low engine speeds, low loads and low temperatures of fuel condensation since the fuel/air charge must travel from the carburetor 21 through the manifold 32, crankcase chamber 19, and transfer passage 36 to the combustion chamber 35. Such fuel condensation would necessitate the running of the engine 11 with a richer than normal mixture if only the carburetor 21 was employed and it served only the crankcase chamber 19. In accordance with an embodiment of the invention, a second charge forming device, indicated generally by the reference numeral 38 is provided for delivering an idle fuel/air charge directly to the transfer passage 36. This charge is delivered through a inlet port 39 that is formed in a wall of the cylinder block 12 which defines the passage 36.

Referring primarily to FIG. 2, the charge forming device or carburetor 38 includes a main body portion 41 having a mixing passage or chamber 42 that terminates in a counterbored area 43 in which a check valve 44 is positioned. The check valve 44 controls communication between the mixing chamber 42 and the inlet port 39 so that flow may only take place fro the chamber 42 into the transfer passage 36. This prevents reverse flows under such times when the pressure in the transfer passage 36 and specifically the pressure at the port 39 is greater than the pressure in the mixing chamber 42.

A fuel/air charge is formed in the chamber 42. For this purpose, there is a fuel inlet port 45 in which a flow controlling restriction 46 is formed. A conduit 47 connects the fuel port 45 with the fuel bowl 24 of the carburetor 21. In this way, it is unnecessary for the charge forming device or carburetor 38 to have its own fuel bowl and fuel supply system.

Air is admitted to the mixing chamber 42 of the carburetor 38 from an air inlet port 48. The air inlet port 48, in turn, receives air through a conduit 49 from the air inlet device 34. If the air inlet device 34 includes a filter element, the conduit 49 will communicate with the inlet device 34 downstream of this filter element. The amount of air admitted to the mixing chamber 42 is controlled by means of a needle-type valve 51 so as to adjust the strength of the fuel/air mixture in the mixing chamber 42.

In accordance with the invention, cold starting and cold running enrichment is also provided for the engine 11 by means of the carburetor 38. For this purpose, an air throttle or choking valve 52 is positioned in the conduit 49. By closing or restricting the valve 52, less air will be admitted to the mixing chamber 42 and an enriched fuel/air mixture will be delivered to the transfer passage 36 for cold starting and cold running enrichment.

If desired, there may also be provided additional fuel flow for this running condition by means of a bypass passage 53 that extends from the conduit 47 through the carburetor body 41 around the restriction 46 and to the mixing chamber 42. A manually operated enrichment valve 54 is provided for controlling the fuel flow through this bypass passage 53.

Since the engine 11 is designed to run on a low grade fuel, it may also be desirable to provide an arrangement for priming the engine 11 for starting with a higher grade fuel such as gasoline. However, the provision of the cold starting enrichment by the carburetor 38 which supplies fuel/air mixture directly to the transfer passage 36 will minimize the necessity for such starting or cold running enrichment. Nevertheless, an arrangement is provided for priming the engine 11 with a higher grade fuel such as gasoline supplied from an auxiliary fuel tank 55.

The fuel tank 55 supplies gasoline or other high quality fuel to a manually operated priming pump 56 through a conduit 57 in which a manually controlled valve 58 is provided. The priming pump 56 includes a body portion 59 defining a pumping chamber or bore 61 in which a piston 62 is slidably supported. The piston 62 is connected by means of a piston rod to an actuating member 63 that can be operated by the operator. The piston 62 is normally urged so as to contract the volume of the bore 61 by means of a compression spring 64. Fuel is admitted from the conduit 57 to the bore 61 through a one-way check valve 65. Fuel is expelled from the bore 61 through a one-way check valve 66 into a conduit 67 that has a discharge nozzle 68 extending into the body of the carburetor 21 and at a point well upstream of the venturi section 22. This will preclude fuel from being drawn from the bore 61 through the conduit 67 under the influence of induction system vacuum as would happen if the nozzle 68 were located in proximity to or downstream of the venturi section 22.

Priming is achieved by the operator pulling the knob 63 so as to withdraw the piston 62 against the action of the spring 64. This will draw fuel from the tank 55 through the conduit 57, assuming the manually operated valve 58 is opened, and check valve 65. When the operator releases the knob 63, the spring 64 will urge the piston 62 in a direction to contract the volume of the bore 61 and drive fuel past the check valve 66 through the conduit 67 out the nozzle 68 into the carburetor induction passage. Upon cranking, this fuel will be drawn into the crankcase chamber 19 so as to provide an enriched mixture for starting.

As has been noted, the engine 11 is particularly adapted for use in outboard motor applications. As such, the engine 11 may at many times be disposed other than in its normal orientation with the axis of the crankshaft 17 extending vertically. Under such instances, there is a likelihood of fuel spillage, particularly from the auxiliary carburetor 38. With devices of this type as previously proposed, the carburetor 38 has been provided with its own air inlet and when the engine is disposed in other than a normal orientation, there is the possibility of fuel spillage out of this air inlet. However, in the embodiment of FIGS. 1 and 2, since the air inlet for the carburetor 38 is supplied through the conduit 49 from the main air intake device 34, the likelihood of such fuel spillage may be avoided.

Figure 3:
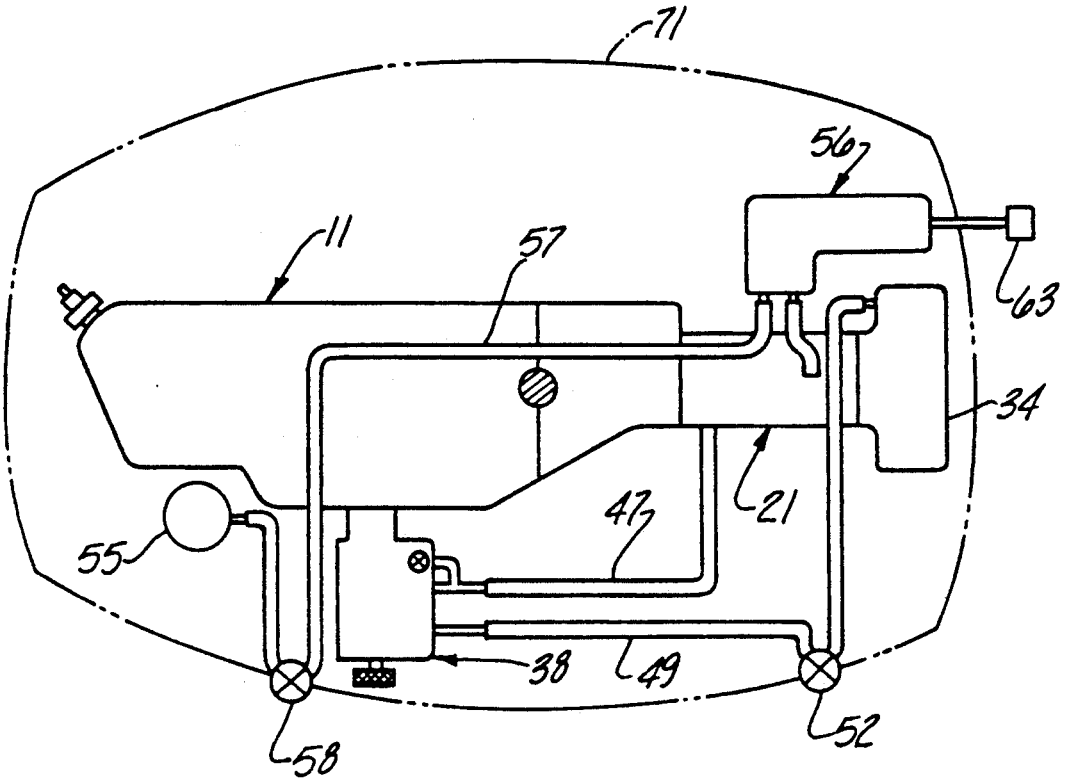
FIG. 3 is a top plan view of another embodiment of the invention.
Figure 4:
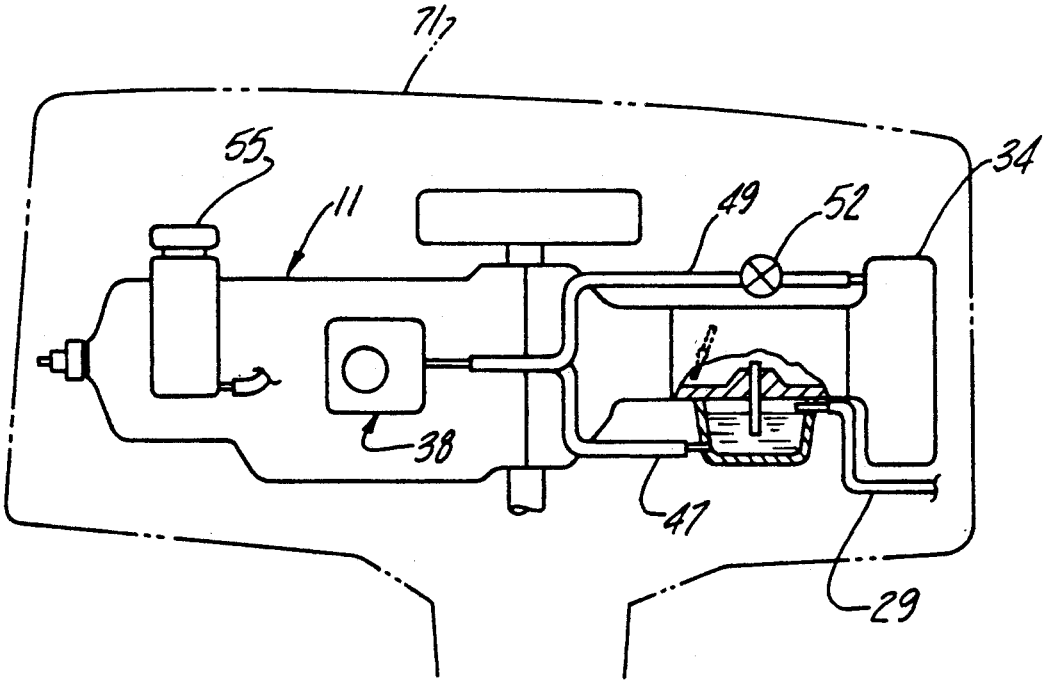
FIG. 4 is a side elevational view, with a portion broken away, of the embodiment of FIG. 3.

FIGS. 3 and 4 illustrate a further embodiment of the invention wherein the likelihood of fuel spillage is still further reduced. In the embodiment of FIGS. 3 and 4, the major components are the same as the embodiment of FIGS. 1 and 2 and, for that reason, they have been indentified by the same reference numeral and will not be described again in detail.

In this embodiment, the air inlet conduit 49 is disposed so that it enters into the air inlet device 34 at its highest level when the engine is disposed in its normal operation position and also so that it will extend into the inlet device 34 at a high level when the engine 11 is positioned in a horizontal direction with the cylinder head 14 extending to the lowermost end. In this embodiment, the cowling of the power head of the associated outboard motor is shown in phantom and is identified generally by the reference numeral 71. In other regards, this embodiment is the same as the embodiment of FIGS. 1 and 2 and, for that reason, the construction of the other components than those described herein will not be repeated.

Figure 5:
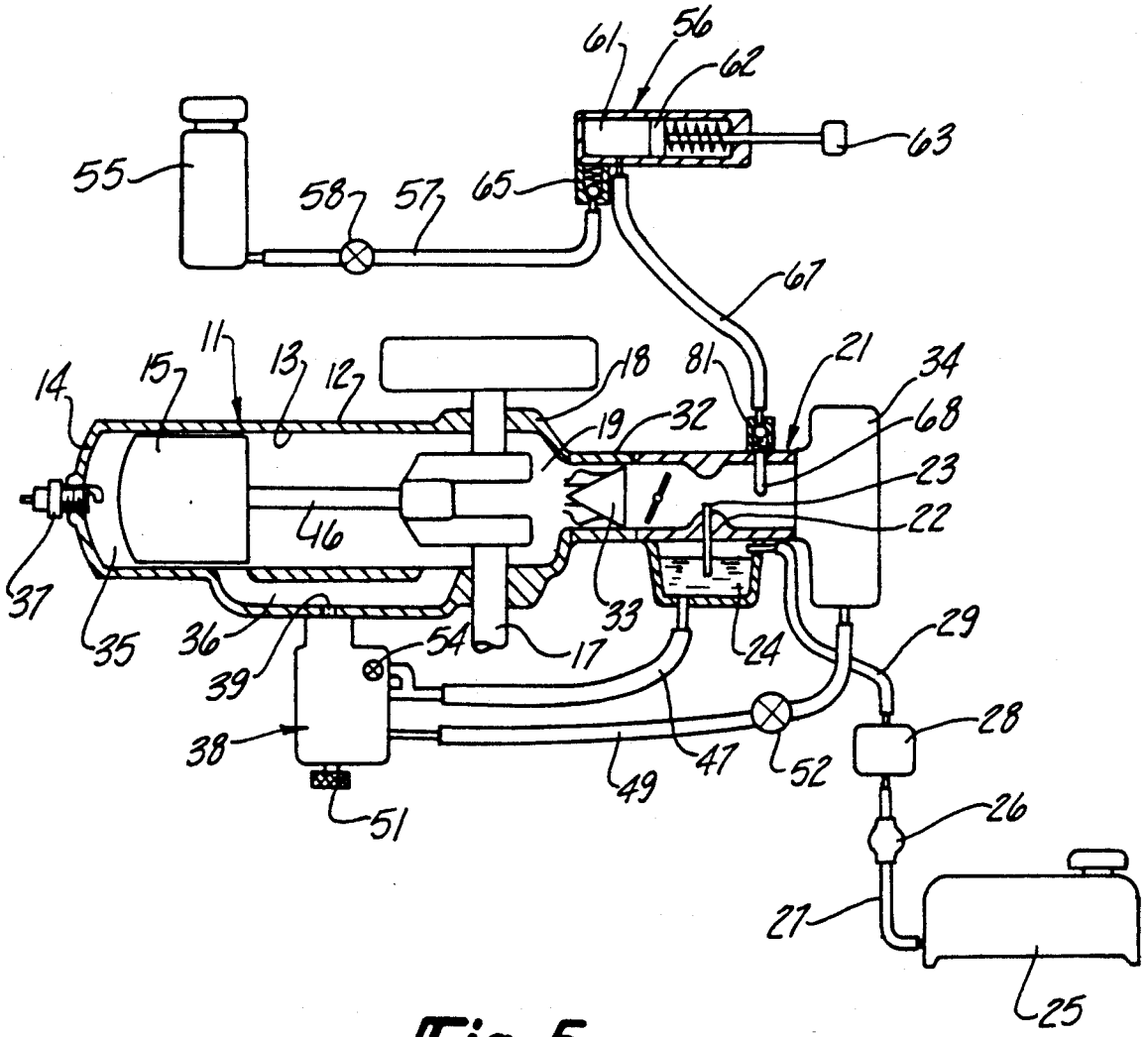
FIG. 5 is a cross-sectional view, in part similar to FIG. 1, showing a further embodiment of the invention.

In the embodiments of FIGS. 1 and 2 and of FIGS. 3 and 4, the priming pump 56 was provided with a discharge check valve 66 that was positioned in direct communication with its bore 61 and upstream of the nozzle 68 and conduit 67. This provides some possibility of fuel leakage from the conduit 67 into the induction passage of the carburetor 21 and could result in unnecessary fuel wastage. An arrangement for avoiding such leakage is shown in the embodiment of FIG. 5. Except for this difference, the embodiment of FIG. 5 is the same as the embodiment of FIGS. 1 and 2 and such common components have been identified by the same reference numeral and will not be described again.

In accordance with this embodiment, a discharge check valve 81 is positioned in the conduit 67 at its downsteam end immediately adjacent the nozzle 68. The check valve 81 will permit fuel to flow under pressure from the chamber 61 and conduit 67 through the nozzle 68 when the piston 62 is urged to contract the volume of the chamber 61. However, this check valve is seated with sufficient pressure so as to preclude fuel from being drawn by gravity through the conduit 67 at the end of the pumping stroke. Thus, the leakage problem which might be attendant with the embodiment of FIGS. 1 and 2 is avoided.

It should be readily apparent from the foregoing description, that several embodiments of charge forming systems and fuel delivery systems have been disclosed for two-cycle, crankcase compression internal combustion engines which provide good running under all conditions and which facilitate the use of operation on low grade fuels such as kerosene, alcohol or the like. Although several embodiments of the invention have been illustrated and described, various other changes and modifications may be made, without departing from the spirit and scope of the invention, as defined by the appended claims.

I claim:

1. In a fuel supply system for a two-cycle, crankcase compression internal combustion engine comprising a cylinder, a piston reciprocating in said cylinder, a crankcase, said engine having a portion defining transfer passage means for transferring a charge compressed in said crankcase to the area in said cylinder above said piston for at least a portion of its stroke, first charge forming means for delivering a fuel/air charge to said crankcase, and second charge forming means for delivering a fuel/air charge directly to said transfer means independently of said crankcase, said second charge forming means comprising a housing affixed directly to said portion of said engine defining said transfer passage means, a fuel/air mixing chamber formed in said housing and communicating directly with said transfer passage means for direct transfer of the formed fuel/air charge to said transfer passage means, means for admitting fuel to said fuel/air mixing chamber, and means for admitting air to said fuel/air mixing chamber, a common air inlet for supplying air to each of said charge forming means comprising an air supply device including at least silencing means.

2. In a fuel supply system as set forth in claim 1 wherein the first charge forming device has only a main fuel discharge and the second charge forming device has an idle fuel discharge.

3. In a fuel supply system as set forth in claim 2 wherein the charge forming means each share a common fuel bowl.

4. In a fuel supply system as set forth in claim 3 wherein the air supply for the second charge forming means enters into the air inlet device at a point vertically above the fuel discharges of both of the charge forming means.

5. In a fuel supply system as set forth in claim 2 wherein the second charge forming means further includes means for providing cold running enrichment.

6. In a fuel supply system as set forth in claim 5 wherein the first charge forming means comprises a venturi section in which the main fuel discharge discharges and further including a priming pump for delivering priming fuel to the first charge forming means upstream of the venturi section.

7. In a fuel supply system as set forth in claim 6 wherein the priming pump is supplied with fuel of a higher quality than the fuel supplied to the first and second charge forming means.

8. In a fuel supply system for a two-cycle, crankcase compression internal combustion engine comprising a cylinder, a piston reciprocating in said cylinder, a crankcase, and said engine having a portion forming transfer passage means for transferring a charge compressed in said crankcase to the area in said cylinder above said piston for at least a portion of the stroke of said piston, first charge forming means for delivering a fuel/air charge to said crankcase, second charge forming means for delivering a fuel/air charge directly to said transfer passage means independently of said crankcase, said second charge forming means comprising a housing affixed directly to said portion of said engine defining said transfer passage means, a fuel/air mixing chamber formed in said housing and communicating directly with said transfer passage means for direct transfer of the formed fuel/air charge to said transfer passage means, means for admitting fuel to said fuel/air mixing chamber, and means for admitting air to the fuel/air mixing chamber, and cold running enrichment means for delivering an enriched fuel/air mixture to said transfer passage means, said first and said second charge forming means being supplied with fuel from the same fuel bowl, the first charge forming means having only a main fuel discharge and the second charge forming means having an idle fuel discharge, and the charge forming means having a common air inlet comprising an air intake device providing at least silencing of the intake air.

9. In a fuel supply system for a two-cycle, crankcase compression internal combustion engine comprising a cylinder, a piston reciprocating in said cylinder, a crankcase, and said engine having a portion forming transfer passage means for transferring a charge compressed in said crankcase to the area in said cylinder above said piston for at least a portion of the stroke of said piston, first charge forming means for delivering a fuel/air charge to said crankcase, second charge forming means for delivering a fuel/air charge directly to said transfer passage means independently of said crankcase, said second charge forming means comprising a housing affixed directly to said portion of said engine defining said transfer passage means, a fuel/air mixing chamber formed in said housing and communicating directly with said transfer passage means for direct transfer of the formed fuel/air charge to said transfer passage means, means for admitting fuel to said fuel/air mixing chamber, and means for admitting air to the fuel/air mixing chamber, and cold running enrichment means for delivering an enriched fuel/air mixture to said transfer passage means, said first and said second charge forming means being supplied with fuel from the same fuel bowl, the first charge forming means having only a main fuel discharge and the second charge forming means having an idle fuel discharge, the charge forming means having a common air inlet comprising an air intake device providing at least silencing of the intake air, and the air supply for the second charge forming device entering into the air inlet at a point vertically above the fuel discharge of each of the charge forming means.

* * * * *